US006620089B2

(12) United States Patent
Miura et al.

(10) Patent No.: US 6,620,089 B2
(45) Date of Patent: Sep. 16, 2003

(54) CENTRIFUGAL SEPARATOR HAVING ROTOR WITH PROJECTION RECEIVED IN RECEIVING MEMBER

(75) Inventors: Masahiro Miura, Hitachinaka (JP); Masaharu Aizawa, Hitachinaka (JP); Yukitoshi Takakusagi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/951,464

(22) Filed: Sep. 14, 2001

(65) Prior Publication Data

US 2002/0035023 A1 Mar. 21, 2002

(30) Foreign Application Priority Data

Sep. 18, 2000 (JP) ..... 2000-282139

(51) Int. Cl.[7] ..... B04B 5/02; B04B 7/02
(52) U.S. Cl. ..... 494/20; 494/60
(58) Field of Search ..... 494/16, 20, 33, 494/60, 84

(56) References Cited

U.S. PATENT DOCUMENTS 3,951,334 A * 4/1976 Fleming et al.
4,431,423 A * 2/1984 Weyant, Jr.
4,435,169 A * 3/1984 Romanauskas
5,707,331 A * 1/1998 Wells et al.

FOREIGN PATENT DOCUMENTS

| | | |
|---|---|---|
| EP | 564834 | * 10/1993 |
| JP | 62-277168 | 12/1987 |
| JP | 25-004240 | 4/1996 |

* cited by examiner

*Primary Examiner*—Charles E. Cooley
(74) *Attorney, Agent, or Firm*—McDermott, Will & Emery

(57) ABSTRACT

A centrifugal separator comprises a driving unit, a power transmission unit including a driving shaft and a crown mounted to one end of the driving shaft, a rotor having a rotor body to which an insertion hole into which the crown is inserted is formed and including a sample holding member, the rotor being formed with a projection member so as to extend outward, a rotor casing into which the rotor is accommodated in a rotatable manner, and a receiving member disposed on the rotor casing side to receive the projection member. In a state that the crown is inserted into the insertion hole from a bottom wall side of the rotor casing, a first distance between the bottom wall of the rotor casing and a front end portion of the crown is made smaller than a second distance between a bottom portion of the projection member and a bottom portion of the insertion hole formed to the rotor body. The receiving member is formed as an annular recess having a depth larger than a difference between the second distance and the first distance.

10 Claims, 3 Drawing Sheets

CENTRIFUGAL SEPARATOR HAVING ROTOR WITH PROJECTION RECEIVED IN RECEIVING MEMBER

BACKGROUND OF THE INVENTION

The present invention relates to a centrifugal separator capable of obviating erroneous use, inclusive of erroneous setting, of a rotor and also relates to a rotor of the centrifugal separator.

FIG. 5 is an illustrated sectional view of an essential portion including a rotor of a centrifugal separator having a conventional structure, and a left-half thereof shows a state that buckets (non-usable buckets) having a large capacity (volume) are swung by a centrifugal force and a right-half thereof shows buckets (usable buckets) having a small capacity are swung by a centrifugal force.

The centrifugal separator comprises a drive unit D, a driving shaft 11 driven and rotated by the drive unit, a crown 4 as a power transmission mounted to a front end of the driving shaft 11 and having a crown pin 6*a*, a swing rotor 1 having a hole 8 into which a crown 4 is inserted and formed with a pin 6*b* to be engaged with the pin 6*a*, a rotor chamber (casing) 10 into which the rotor 1 is accommodated and a cover 12 covering an opening between the rotor casing 10 and the driving shaft 11. A door, not shown, may be further provided for opening or closing an upper opening of the rotor casing 10 through which the swing rotor 1 is inserted into or taken out from the rotor casing 10.

Rotors for holding samples generally include a vertical rotors, angle rotors, swing rotors and so on, and the swing rotor is different from the other type rotors. The swing rotor 1 is provided with a rotor body 2, an arm 9 provided for the rotor body 2 and a plurality of buckets 3 arranged to the arm 9 so that the buckets 3 are swingable in the centrifugal direction with the arm 9 being the swing rotation center thereof.

In order to treat a lot of samples at one time by using a swing rotor, it will be necessary to make large the bucket, in size, for holding the sample and also necessary to design the rotor chamber, into which the rotor is accommodated, so as to have an inner diameter D3 larger than the maximum rotating diameter D2 of the swing rotor at a time when the bucket is swung from the vertical direction towards the horizontal direction (i.e. the diameter D2 of the swing rotor at the time of being rotated at the maximum rotating rate).

In general, the separation of the sample is performed by using a swing rotor which was preliminarily selected so as to conform with the inner diameter of the rotor casing. However, in some occasion, this swing rotor is to be exchanged with another swing rotor in accordance with its use or object. In such case, however, a swing rotor having the maximum rotating diameter D2 larger than the inner diameter D3 of the rotor casing 10 can be accommodated because the maximum outer diameter D1 of the swing rotor at the operation stopping time (not driving time) is smaller than the inner diameter D3 of the rotor casing 10. In such state, when an operator operates the swing rotor 1 without acknowledging this selection error of the swing rotor (erroneous setting), the buckets are being swung by the centrifugal force will contact the inside wall section having the inner diameter D3 of the rotor casing 10 smaller than the maximum rotating diameter D2 of the swing rotor 1, thus damaging the rotor, loosing the sample, and hence, damaging the centrifugal separator itself, hence being defective.

SUMMARY OF THE INVENTION

An object of the present invention is to substantially eliminate defects or drawbacks encountered in the prior art mentioned above and to provide a centrifugal separator capable of safely achieving an improved working efficiency with less setting error of the rotor.

Another object of the present invention is to also provide a rotor of the centrifugal separator of the character mentioned above which is superior in safe operation and operational reliability.

These and other objects can be achieved according to the present invention by providing, in one aspect, a centrifugal separator comprising:

a driving unit;

a power transmission unit including a driving shaft operatively connected to the driving unit to be rotatable and a crown mounted to one end of the driving shaft;

a rotor having a rotor body to which an insertion hole into which the crown is inserted is formed and including a sample holding member, the rotor being formed with a projection member so as to extend outward;

a rotor casing into which the rotor is accommodated in a rotatable manner; and a receiving member disposed on the rotor casing side and adapted to receive the projection member, wherein, in a state that the crown is inserted into the insertion hole from a bottom wall side of the rotor casing, a first distance between the bottom wall of the rotor casing and a front end portion of the crown is made smaller than a second distance between a bottom portion of the projection member and a bottom portion of the insertion hole formed to the rotor body and wherein the receiving member is formed as an annular recess, i.e. groove, the annular recess having a depth larger than a difference between the second distance and the first distance.

The receiving member is an annular recess and the projection member is an annular projection, or comprises a plurality of projection pins, having a center arranged on a rotational axis of the driving shaft.

The rotor casing is formed with an opening through which the driving shaft extends into the rotor casing, a cover is disposed so as to cover the opening, and the receiving member is formed to the cover.

The rotor is a swing rotor and the sample holding member comprises a plurality of buckets. The rotor body of the swing rotor is formed with cutouts into which downward end portions of the buckets are received, respectively, at a time when the swing rotor is stopped in operation.

In a further aspect of the present invention, there is provided a rotor to be accommodated in a rotor casing comprising:

a rotor body having a rotational axis about which the rotor body is rotated and having an insertion hole into which a power transmission member for rotating the rotor body is fitted, the rotor body being formed with a projection member which is received in a receiving member formed to the rotor casing side; and a plurality of sample holding members arranged on a circumferential portion with the rotational axis being the center thereof, wherein, in a state that the crown is inserted into the insertion hole from a bottom wall side of the rotor casing, a first distance between the bottom wall of the rotor casing and a front end portion of the power transmission member is made smaller than a second distance between a bottom portion of the projection member and a bottom portion of the insertion hole formed to the rotor body.

In preferred examples of this aspect, the projection member is an annular projection having a center arranged on a rotational axis of the power transmission member. The projection member may comprise a plurality of projection pins arranged in an annular shape having a center arranged on a rotational axis of the power transmission member.

The rotor is a swing rotor and the sample holding member comprises a plurality of buckets. The rotor body of the swing rotor is formed with cutouts into which downward end portions of the buckets are received, respectively, at a time when the swing rotor is stopped in operation.

According to the centrifugal separator and the rotor thereof of the characters mentioned above, the setting errors of the rotor, particularly, swing rotor, can be substantially eliminated by the specific location of the annular projection member formed to the rotor body and the annular groove for receiving the projections, and therefore, the working efficiency of the centrifugal separator can be improved, thus being safe and advantageous.

Furthermore, the safeness and reliability, in operation, rotor can be also provided.

Still furthermore, in a preferred aspect, the swing rotor having the maximum rotating diameter larger than the inner diameter of the rotor casing into which the swing rotor is accommodated cannot be mounted in a rotatable manner, and moreover, the swing rotor of the present invention can be rotated by using a centrifugal separator specific to such swing rotor. Therefore, the safeness and reliability for the operation of the centrifugal separator can be ensured.

The nature and further characteristic features of the present invention will be made more clear from the following descriptions made with reference to the accompanying drawings.

DESCRIPTION OF THE PREFERRED EMBODIMENTS

Figure 1:
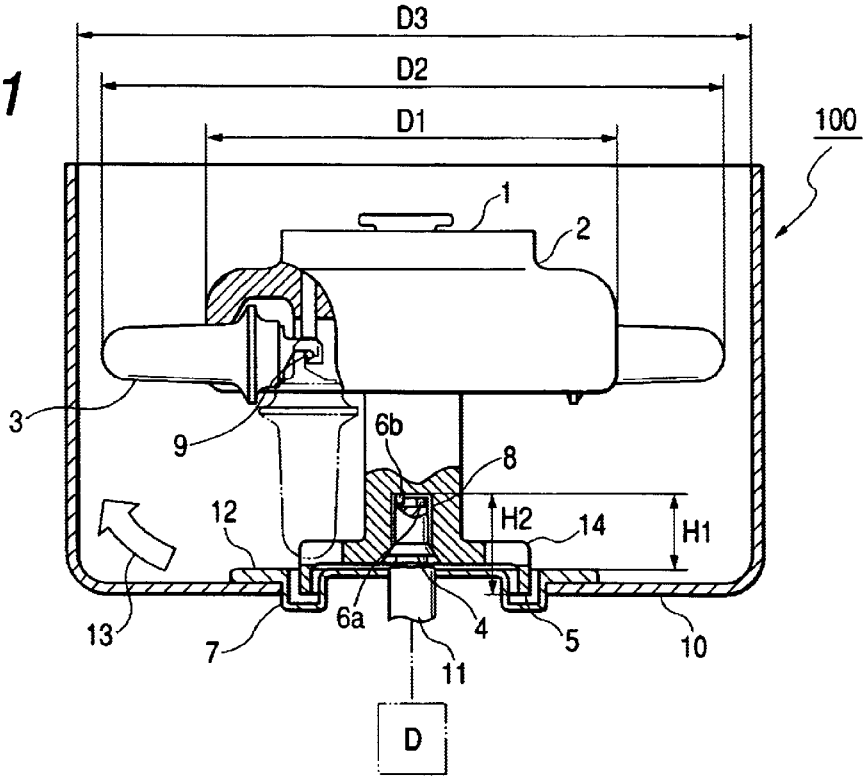
FIG. 1 is an illustrated elevational section, in an enlarged scale, showing an essential portion including a rotor of a centrifugal separator now operated according to one embodiment of the present invention.

A preferred embodiment of a centrifugal separator of the present invention will be described hereunder with reference to FIGS. 1 to 4.

A centrifugal separator 100 comprises a drive means D such as electric motor, a driving shaft 11 extending from the drive means D, a power transmission 4 such as crown (called crown hereinlater) mounted to a front end portion of the driving shaft 11 and formed with a pin 6*a*, a swing rotor 1 formed with a hole 8 into which the crown 4 is inserted and also formed with a pin 6*b* engaged with the pin 6*a* formed to the crown 4, a rotor casing (chamber) 10 into which the swing rotor 1 is accommodated, and a cover 12 for closing an opening formed between the rotor casing 10 and the driving shaft 11. A door, not shown, is also provided for an upper opening of the rotor casing 10 through which the swing rotor 1 is put into or taken out from the rotor casing 10.

The swing rotor 1 is generally composed of a rotor body 2, an arm 9 formed to the rotor body 2 and a plurality of buckets 3 to be capable of being swung in the centrifugal direction with the arm being the center of swinging (rotating) motion. Further, the swing rotor 1 is formed, at its bottom portion as viewed in FIG. 1, for example, with the tapered insertion hole 8 into which the crown 4 is inserted. The pin 6*b* is formed to the insertion hole 8 so as to be engaged with the pin 6*a* of the crown 4 to prevent the crown 4 from being slid in the rotating direction thereof.

Recently, in spite of the size reduction requirement for the centrifugal separator because of reduced location space, there has been increasing a tendency to treat at once a large amount or number of samples. Because of this reason, it is necessary to change the design of the rotor casing 10, i.e. increase the capacity thereof, without changing (i.e. increasing) the size of the centrifugal separator 100 as little as possible.

However, the rotation (rotating) diameter of the bucket 3 of the swing rotor 1 largely varies due to the centrifugal force generated at the swinging operation of the rotor 1. However, if a certain rotor provided with buckets having a diameter smaller than an inner diameter D3 of the rotor casing 10 at a time of being not rotated and having a maximum rotating diameter D2 larger than the inner diameter D3 of the rotor casing 10 is erroneously mounted to the rotor casing 10, the buckets adversely contact or collide with the rotor casing wall, thus being defective and dangerous.

In order to obviate such defect and to rotate the swing rotor 1 with no problem, according to the present invention, an annular projection 5 is formed to the bottom portion of the rotor 1 and an annular recess such as groove 7 is formed to the cover 12 disposed to an inner bottom surface of the rotor casein 10, the annular projection 5 being inserted into the annular groove 7 to thereby engage the swing rotor 1 with the crown 4 in a rotatable manner through the engagement of the pins 6*a* and 6*b* formed thereto, respectively. Thus, the operator can recognize the engaging condition between the swing rotor 1 and the crown 4 by observing the relative positional relationship between the annular projection 5 and the annular groove 7.

Figure 2:
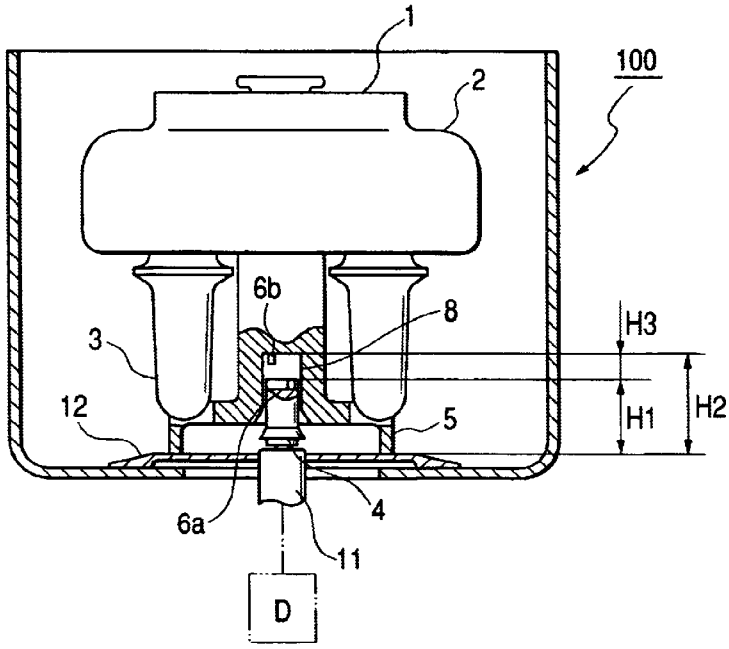
FIG. 2 is an illustrated elevational section of FIG. 1, but in an operation stopping state, i.e. not driven state.

Further, the cover 12 is formed with the annular groove 7 with a depth H3 larger than a distance (H2−H1), in which, with reference to FIGS. 1 and 2, a distance H1 between the upper surface of the cover 12 disposed on the inner bottom surface of the rotor casing 10 and the front end portion of the inserted crown 4 is smaller than a distance H2 between the bottom surface of the swing rotor 1 and the bottom of the insertion hole 8 (H1<H2).

According to the structure of the swing rotor 1 mentioned above, in the case where the centrifugal separator capable of rotating, with no problem, the swing rotor 1 having buckets 3 of large capacity or volume is utilized as shown in FIG. 1, when the crown 4 is mounted to the swing rotor 1, the annular projection 5 formed to the lower portion (bottom portion) of the swing rotor 1 is received in the annular groove 7 without interfering (contacting) formed to the cover 12 disposed to the inner bottom surface of the rotor casing (chamber) 10, whereby the swing rotor 1 and the crown 4 can be engaged through the pins 6*a* and 6*b* to be rotatable.

Figure 3A:
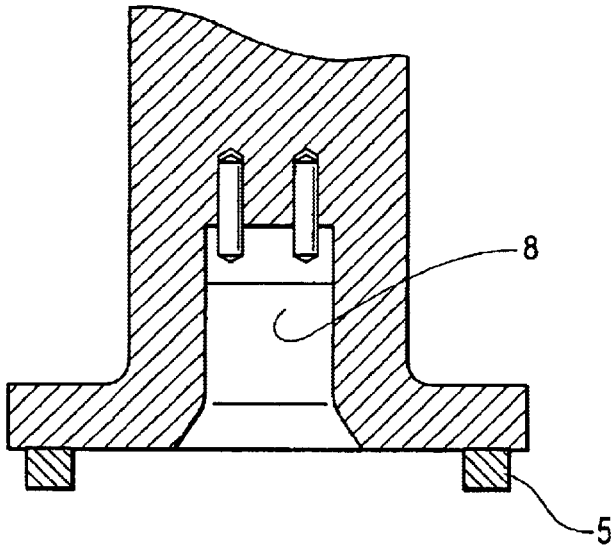
FIG. 3A is a side view of a swing rotor provided with another example of projections formed to a bottom surface thereof and FIG. 3B a bottom view thereof.
Figure 3B:
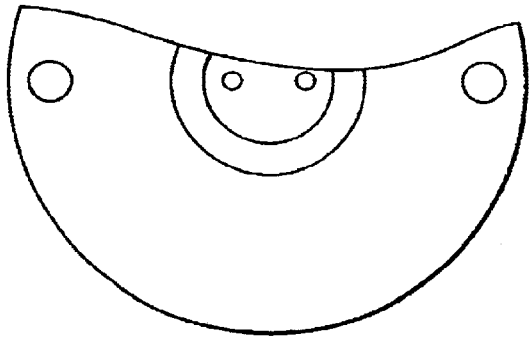
Figure 4:
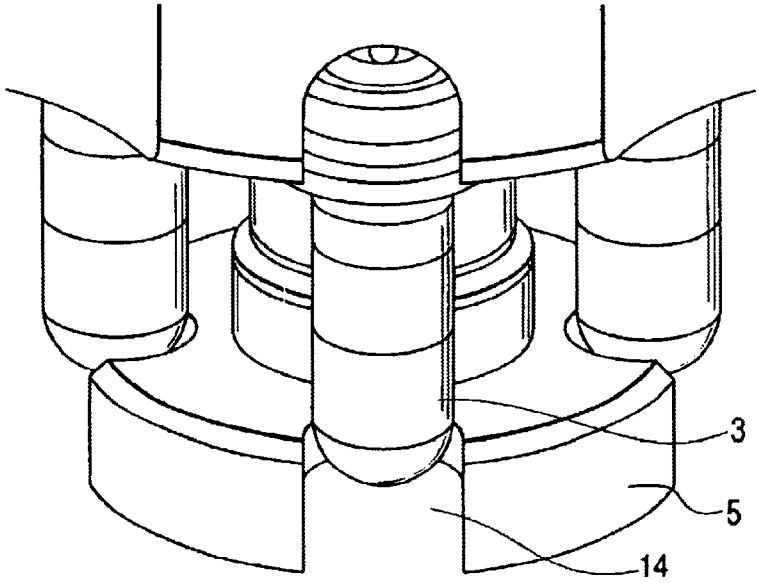
FIG. 4 is a perspective view of a portion of the rotor of FIG. 3 provided with the projections in an enlarged scale.
Figure 5:
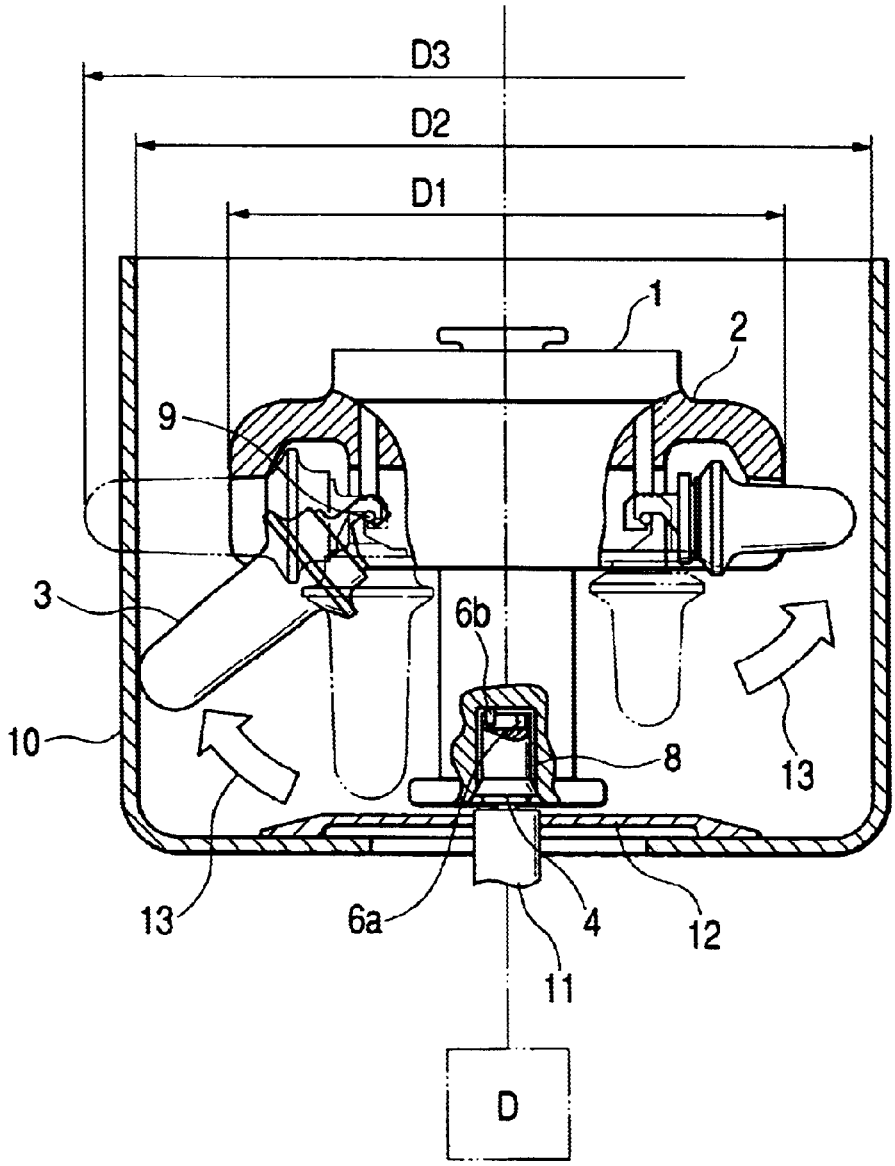
FIG. 5 PRIOR ART
FIG. 5 is an illustrated sectional view of an essential portion including a rotor of a centrifugal separator having a conventional structure.

The annular projection 5 formed to the lower portion of the swing rotor 1, with the driving axis being the center of this annular shape, may be substituted with a plurality of pin-shaped projections projecting in annular form with the driving axis being the center as shown in FIG. 3A. Such projections will be easily worked in a manufacturing process. Furthermore, in the present invention, it is necessary to lower the center of gravity of the swing rotor 1 in order to obtain a stable rotating performance, and therefore, the achieving of such matter is made by forming cutouts 14 around the projection 5 for receiving the lower portions of the buckets 3 at the operation stopping time (no-rotation period), this state being represented by FIG. 4.

On the other hand, in the case where the centrifugal separator in which the swing rotor 1 having buckets 3 of large capacity or volume cannot be rotated because the maximum rotating diameter of the buckets 3 are larger than the inner diameter of the rotor casing 10 is utilized as shown in FIG. 2, since the cover 12 if formed with no annular groove 7, the projection 5 merely contacts the upper surface of the cover 12 and the crown 4 and the swing rotor 1 are positioned so as not to be engaged with each other through the pins 6*a* and 6*b*. That is, the swing rotor 1 and the crown 4 cannot be engaged with each other in accordance with the projecting amount (projection length) of the projection 5. Thus, even if an operator sets a swing rotor to a centrifugal separator provided with a rotor casing 10 having an inner diameter D3 smaller than the maximum rotating diameter D2 of the swing rotor, the swing rotor 1 cannot be engaged with the crown 4 to be rotatable because the annular projection 5 and the annular groove 7 cannot be rotatably engaged through the engagement of the pins 6*a* and 6*b*. This state is represented by FIG. 2. According to such fact, the operator recognizes the setting miss of the swing rotor, and hence, any damage or like of the swing rotor can be obviated, thus being advantageous.

As mentioned above, according to the present invention, the swing rotor having the maximum rotating diameter larger than the inner diameter of the rotor casing into which the swing rotor is accommodated cannot be mounted in a rotatable manner, and moreover, the swing rotor of the present invention can be rotated by using a centrifugal separator specific to such swing rotor. Therefore, the safeness and reliability for the operation of the centrifugal separator can be ensured.

In modified examples, the annular groove 7 of the described embodiment may be substituted with an annular through hole, and a vertical rotor or angle rotor may be effectively utilized in place of the swing rotor 1.

It is to be noted that the present invention is not limited to the described embodiment and modified examples and many other changes and modifications may be made without departing from the scope of the amended claims.

What is claimed is:

1. A centrifugal separator comprising:

a driving unit;

a power transmission unit including a driving shaft operatively connected to the driving unit to be rotatable and a crown mounted to one end of the driving shaft;

a swing rotor having a rotor body to which an insertion hole into which the crown is inserted is formed and including a sample holding member comprising a plurality of buckets, said swing rotor being formed with a projection member so as to extend outward;

a rotor casing into which said swing rotor is accommodated in a rotatable manner; and a receiving member disposed on a side of the rotor casing and adapted to receive said projection member, wherein, in a state that the crown is inserted into the insertion hole formed to the rotor body from a bottom wall side of the rotor casing, a first distance between the bottom wall of the rotor casing and a front end portion of the crown is made smaller than a second distance between a bottom portion of the projection member and a bottom portion of the insertion hole and wherein said receiving member is formed as an annular recess, said annular recess having a depth larger than a difference between the second distance and the first distance.

2. The centrifugal separator according to claim 1, wherein said receiving member is an annular recess and said projection member is an annular projection having a center arranged on a rotational axis of the driving shaft.

3. The centrifugal separator according to claim 1, wherein said receiving member is an annular recess and said projection member comprises a plurality of projection pins arranged in an annular shape having a center arranged on a rotational axis of the driving shaft.

4. The centrifugal separator according to claim 1, wherein said rotor casing is formed with an opening through which said driving shaft extends into the rotor casing, a cover is disposed so as to cover said opening, and said receiving member is formed to the cover.

5. The centrifugal separator according to claim 1, wherein said receiving member is composed of an annular groove.

6. The centrifugal separator according to claim 1, wherein the rotor body of the swing rotor is formed with cutouts into which downward end portions of the buckets are received.

7. A combination of rotor and a rotor casing comprising:

a swing rotor provided with a rotor body having a rotational axis about which the rotor body is rotated and having an insertion hole, with a power transmission member fitted to the insertion hole so as to rotate the rotor body, said rotor body being formed with a projection member, and provided with a plurality of sample holding members, which comprise a plurality of buckets, arranged on a circumferential portion with the rotational axis being the center thereof; and a rotor casing into which said swing rotor is accommodated, said rotor casing being provided with a receiving member for receiving the projection member formed to the rotor body, wherein, in a state that crown is inserted into the insertion hole formed to the rotor body from a bottom wall side of the rotor casing, a first distance between the bottom wall of the rotor casing and a front end portion of the power transmission member is made smaller than a second distance between a bottom portion of the projection member and a bottom portion of the insertion hole formed to the rotor body.

8. The combination according to claim 7, wherein said projection member is an annular projection having a center arranged on a rotational axis of the power transmission member.

9. The combination according to claim 7, wherein said projection member comprises a plurality of projection pins arranged in an annular shape having a center arranged on a rotational axis of the power transmission member.

10. The combination according to claim 7 wherein the rotor body of the swing rotor is formed with cutouts into which downward end portions of the buckets are received, respectively, at a time when the swing rotor is stopped in operation.

* * * * *